US005396957A

United States Patent [19]

Surjaatmadja et al.

[11] Patent Number: 5,396,957

[45] Date of Patent: Mar. 14, 1995

[54] WELL COMPLETIONS WITH EXPANDABLE CASING PORTIONS

[75] Inventors: Jim B. Surjaatmadja; Timothy W. Helton; Danny G. Porter, all of Duncan, Okla.

[73] Assignee: Halliburton Company, Duncan, Okla.

[21] Appl. No.: 206,560

[22] Filed: Mar. 4, 1994

Related U.S. Application Data

[63] Continuation-in-part of Ser. No. 129,922, Sep. 30, 1993, Pat. No. 5,325,923, which is a continuation-in-part of Ser. No. 953,671, Sep. 29, 1992, Pat. No. 5,249,628.

[51] Int. Cl.[6] ..... E21B 43/00

[52] U.S. Cl. ..... 166/308; 166/271

[58] Field of Search ..... 166/305.1, 307, 308, 166/271, 281, 268

[56] References Cited

U.S. PATENT DOCUMENTS

| | | | |
|---|---|---|---|
| 4,850,431 | 7/1989 | Austin et al. | 166/308 |
| 4,949,788 | 8/1990 | Szarka et al. | 166/285 |
| 4,979,561 | 12/1990 | Szarka | 166/240 |
| 4,991,653 | 2/1991 | Schwegman | 166/312 |
| 4,991,654 | 2/1991 | Brandell et al. | 166/332 |
| 5,029,644 | 7/1991 | Szarka et al. | 166/223 |
| 5,133,410 | 7/1992 | Gadelle et al. | 166/308 |
| 5,174,340 | 12/1992 | Peterson et al. | 138/110 |
| 5,249,628 | 10/1993 | Surjaatmadja | 166/308 |

*Primary Examiner*—Michael Powell Buiz

*Attorney, Agent, or Firm*—Stephen R. Christian; Neal R. Kennedy

[57] ABSTRACT

Expandable casing portions are provided, such as casing slip joints or expansion joints, on opposite sides of a fracture initiation location to accommodate casing and formation movement during fracturing of a well. The fracture initiation location provided by forming openings through the well casing and then forming fan-shaped slots in the formation surrounding the casing. These fan-shaped slots circumscribe an angle about the axis of the casing substantially greater than the angle circumscribed by the opening itself through which the slot was formed. These techniques are particularly applicable to fracturing of horizontal wells, but are also useful on vertical wells. The expansion joints formed as tubular members having alternating inner and outer annular grooves. In another embodiment, the expansion joints formed by tubular members defining alternating inner and outer spiral grooves therein.

24 Claims, 7 Drawing Sheets

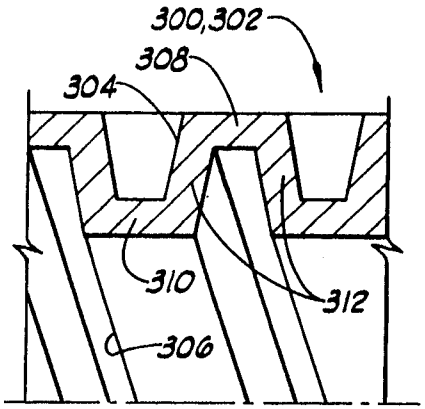
FIG. 10
FIG. 11
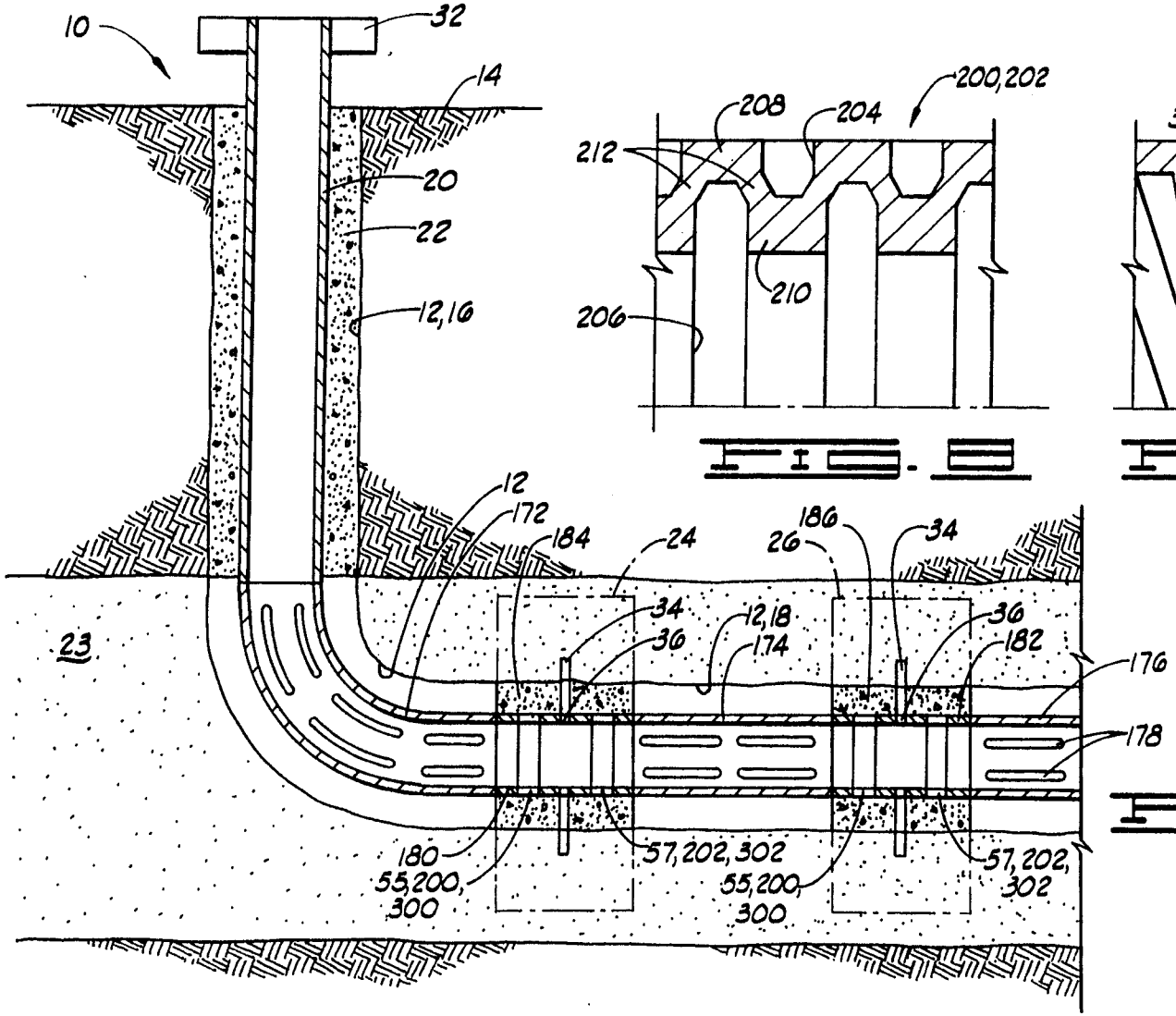
FIG. 12

WELL COMPLETIONS WITH EXPANDABLE CASING PORTIONS

This is a continuation in part of application Ser. No. 08/129,922, filed Sep. 30, 1993, which is a continuation in part of U.S. Pat. No. 5,249,628, issued Oct. 5, 1993, Ser. No. 07/953,671, filed Sep. 29, 1992.

BACKGROUND OF THE INVENTION

1. Field of the Invention

The present invention relates generally to the completion of oil and gas wells through fracturing operations, and more particularly, but not by way of limitation, to the completion of wells in which the formation tends to open up in the direction of the wellbore.

2. Description of the Prior Art

Several different techniques are currently used for the completion of horizontal wells.

A first, very common manner of completing a horizontal well is to case and cement the vertical portion of the well and to leave the horizontal portion of the well which runs through the producing formation as an open hole, i.e., that is without any casing in place therein. Hydrocarbon fluids in the formation are produced into the open hole and then through the casing in the vertical portion of the well.

A second technique which is commonly used for the completion of horizontal wells is to place a length of slotted casing in the horizontal portion of the well. The purpose of the slotted casing is to present the open hole from collapsing. A gravel pack may be placed around the slotted casing. The slotted casing may run for extended lengths through the formation, for example as long as one mile.

A third technique which is sometimes used to complete horizontal wells is to cement casing in both the vertical and horizontal portions of the well and then to provide communication between the horizontal portion of the casing and the producing formation by means of perforations or casing valves. The formation may also be fractured by creating fractures initiating at the location of the perforations or the casing valves.

In this third technique, the formation of perforations is often done through use of explosive charges which are carried by a perforating gun. The explosive charges create holes which penetrate the side wall of the casing and penetrate the cement surrounding the casing. Typically, the holes will be in a pattern extending over a substantial length of the casing.

When the communication between the casing and the producing formation is provided by casing valves, those valves may be like those seen in U.S. Pat. No. 4,949,788 to Szarka et al., U.S. Pat. No. 4,979,561 to Szarka, U.S. Pat. No. 4,991,653 to Schwegman, U.S. Pat. No. 5,029,644 to Szarka et al., and U.S. Pat. No. 4,991,654 to Brandell et al., all assigned to the assignee of the present invention. Such casing valves also provide a large number of radial bore type openings communicating the casing bore with the surrounding formation.

When utilizing either perforated casing or casing valves like those just described, the fracturing fluid enters the formation through a large multitude of small radial bores at a variety of longitudinal positions along the casing and there is no accurate control over where the fracture will initiate and in what direction the fracture will initiate.

In the context of substantially deviated or horizontal wells, the cementing of casing into the horizontal portion of the well followed by subsequent fracture treatments has not been as successful as desired when using existing techniques, especially when multiple zone fracturing is involved.

SUMMARY OF THE INVENTION

It has been determined that one of the reasons fracturing of horizontal wells has not been completely satisfactory in the past is that when a fracture radiates outward in a plane transverse to and preferably perpendicular to the longitudinal axis of the casing, the subsurface formation tends to move on either side of the fracture in a direction generally parallel to the longitudinal axis of the casing, but the casing itself cannot move. Thus, the relative movement between the subsurface formation and the casing often causes a destruction of the bond between the casing and the surrounding cement. This destruction of the cement/casing bond may extend for large distances thus providing a path of communication between adjacent subsurface formations which are to be fractured.

The improved fracturing technique of the present invention eliminates this problem. This is accomplished by providing expandable casing portions adjacent the location where the fracture is to be initiated. Preferably, such expandable casing portions are provided on both sides of the fracture initiation location. The expandable casing portions allow the casing to move with the expanding formation when fracturing occurs. This aids in preventing a destruction of the bond between the cement and the casing. Preferably, the use of expandable casing portions is accompanied by the provision of a means for directing the initial direction of fracture initiation so that the fracture initiates in a plane generally perpendicular to the longitudinal axis of the casing.

It has been determined that another reason fracturing of horizontal wells has not been completely satisfactory in the past is that the stresses which are created within the formation immediately surrounding the casing and cement in a horizontal well are such that quite often the fracture will not radiate outward in a plane perpendicular to the axis of the well when it is most desirable, but instead quite often the fracture will run parallel to the casing and thus will allow communication between adjacent formations.

The present invention includes an improved method for initially communicating the casing bore with the surrounding formation so as to provide a predetermined point of initiation of the fracture and so as to provide directional guidance to the fracture when it is initiated.

This method is accomplished by inserting a hydraulic jetting tool into the casing. One or more openings are formed through the casing, and preferably those openings are formed by the hydraulic jetting tool itself.

The hydraulic jetting tool is then used to direct a hydraulic jet through the opening in the casing and the jetting tool is pivoted so as to cut one or more fan-shaped slots in the surrounding formation in a plane transverse to the longitudinal axis of the casing. Each of these fan-shaped slots circumscribes a substantially larger arc about the axis of the casing than does the opening through which the slot was cut.

Preferably these fan-shaped slots lie in a plane substantially perpendicular to the longitudinal axis of the casing.

Subsequently, when fracturing fluid is applied under pressure to the fan-shaped slots, the fracture will initiate in the plane of the fan-shaped slots and will at least initially radiate outward from the wellbore along that plane. This will occur regardless of the orientation of the natural least principal stress axis within the surrounding formation.

The provision of the fan-shaped slots will allow initiation of the fracture and allow it to move outward away from the wellbore sufficiently so that the direction of the fracture will not be controlled by the local stresses immediately surrounding the casing and wellbore which might otherwise cause the fracture to follow the wellbore.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 8 shows the second embodiment expandable casing portion in an expanded position.

FIG. 10 shows the third embodiment expandable casing portion in an expanded position.

FIG. 12 is a view similar to FIG. 1 illustrating the use of the invention in combination with slotted casing in an open borehole in parts of the horizontal portion of the well.

DETAILED DESCRIPTION OF THE PREFERRED EMBODIMENTS

Figure 1:
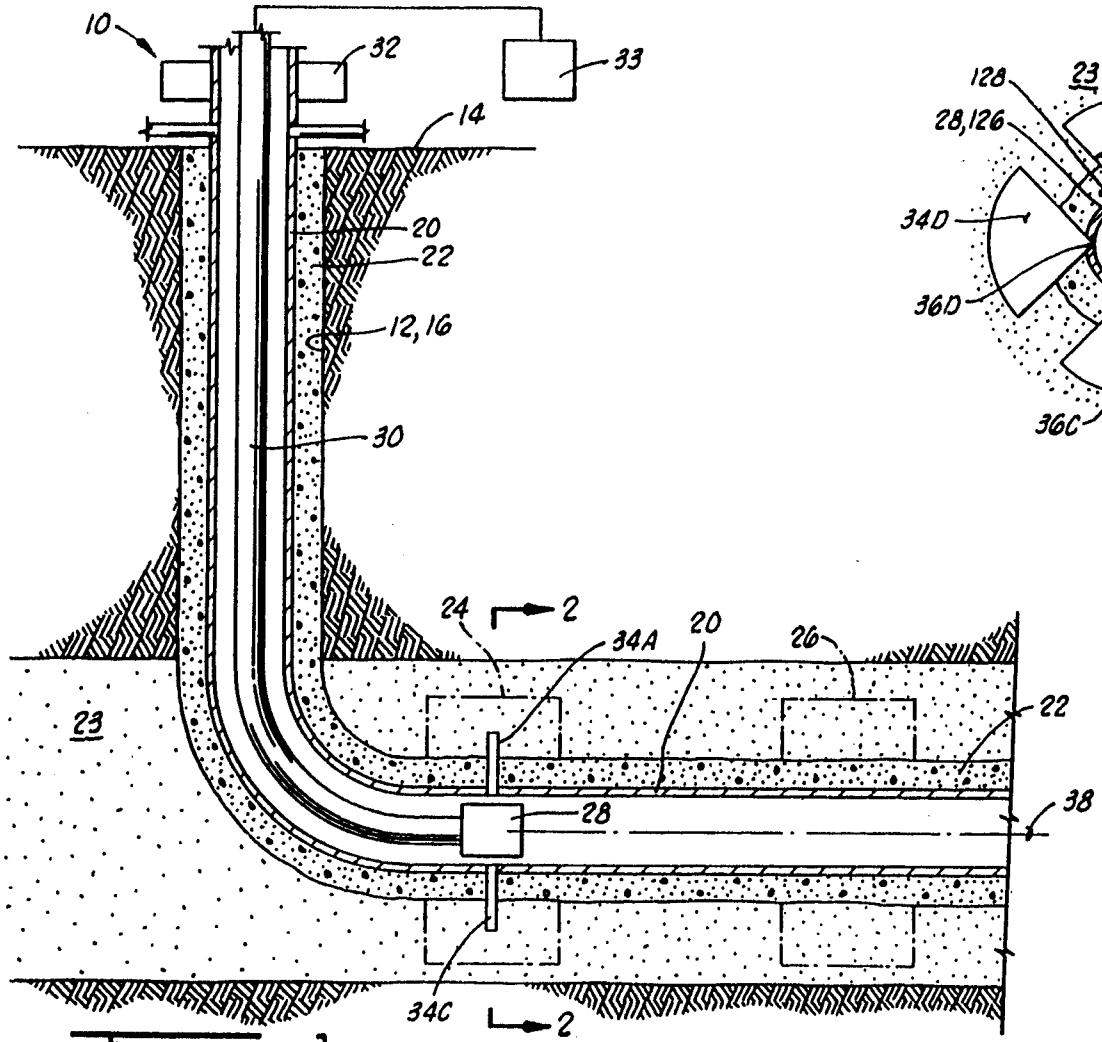
FIG. 1 is an elevation schematic sectioned view of a well having a horizontal portion which has been cased and cemented. The formation is shown as having had radially extending fan-shaped slots cut therein.

Referring now to the drawings, and particularly to FIG. 1, a well is shown and generally designated by the numeral 10. The well is formed by a wellbore 12 which extends downward from the earth's surface 14. The wellbore 12 is illustrated as having an initial, generally vertical portion 16 and a lower, generally horizontal portion 18, but the invention may be applicable to other well configurations.

The well 10 includes a casing string 20 which is located within the wellbore 12 and cemented in place therein by cement 22.

The horizontal portion 18 of wellbore 12 is shown as intersecting a subterranean formation 23 in which are located two imaginary zones which are to be fractured. The zones are outlined in phantom lines and are generally designated by the numerals 24 and 26.

A hydraulic jetting tool schematically illustrated and designated by the numeral 28 has been lowered into the casing 20 on a tubing string 30. A conventional wellhead 32 is located at the upper end of the well at the earth's surface.

A source of high pressure fluid 33 is connected to the tubing string 30 to provide hydraulic fluid under high pressure to the hydraulic jetting tool 28.

In the first zone 24, two fan-shaped slots 34A and 34C are shown in cross section extending through the cement 22 into the surrounding zone 24. The slots have been cut by the hydraulic jetting tool 28 in a manner further described below.

Figure 2:
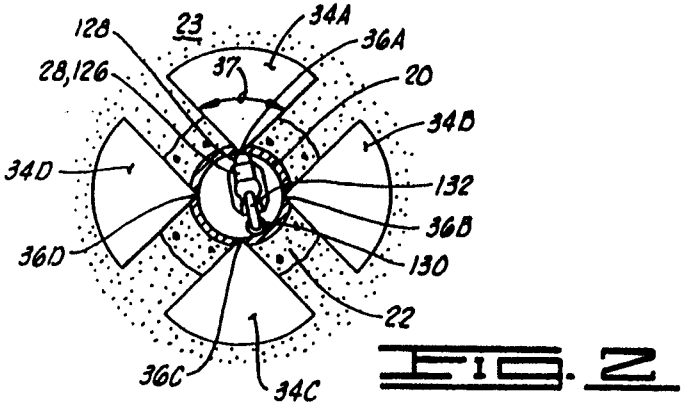
FIG. 2 is a schematic view taken along line 2—2 of FIG. 1 in a plane perpendicular to the longitudinal axis of the wellbore showing four fan-shaped slots surrounding the casing.

FIG. 2 is a cross-sectional view taken along line 2—2 of FIG. 1 and showing a preferred pattern of fan-shaped slots including four fan-shaped slots 34A, 34B, 34C and 34D.

As seen in FIG. 2, there is associated with each of the fan-shaped slots 34A, 34B, 34C and 34D an opening 36 formed through the casing 20. These openings are designated by the numerals 36A, 36B, 36C and 36D, respectively.

The fan-shaped slots 34 are shown as lying in a plane substantially perpendicular to a longitudinal axis 38 of the horizontal portion of the casing 20.

In FIG. 2, the hydraulic jetting tool 28 is shown in position for formation of the opening 36A and radial fan-shaped slot 34A.

Preferably, the opening 36A is formed through the casing 20 by the hydraulic jetting action of jetting tool 28. Then, using the opening 36A as a base or pivot point, the hydraulic jetting tool 28 is rotated back and forth through an arc corresponding to an angle 37 formed by the fan-shaped slot about the point of the opening 36A so that the hydraulic jet which shoots through the opening 36A will cut the fan-shaped slot 34A.

As is apparent in FIG. 2, the fan-shaped slot 34A circumscribes a substantially larger arc about the axis 38 of casing 20 than does the small opening 36A through which the fan-shaped slot 34A was cut.

In its broadest terms, the fan-shaped slot concept does not require that the pivotal base of the slot 34 be located at the opening 36. It is required, however, that the slots be formed in a manner such that the structural integrity of the casing is maintained.

Although it is preferred to form the openings 36 by the hydraulic jetting action just described, it is also within the scope of the present invention to use preformed holes, such as those which would be provided by a casing valve like that shown in Brandell et al., U.S. Pat. No. 4,991,654, in which case the jetting tool 28 would be located adjacent an existing hole provided in the casing valve and the fan-shaped slots would be cut through the existing holes of the casing valve.

It is also within the scope of the present invention to cut the fan-shaped slots 34 in planes other than planes perpendicular to the longitudinal axis 38. Also, the fan-shaped slots may be cut in a vertical portion rather than a horizontal portion of the well.

Furthermore, it is possible to cut the fan-shaped slots 34 to modify the well 10 for reasons other than fracturing the well. For example, the fan-shaped slots 34 may be utilized as a substitute for perforations communicating the casing bore with the surrounding formation.

By forming the fan-shaped slots 34 as shown in FIG. 2 wherein each slot 34 circumscribes a substantially larger arc about the longitudinal axis 38 than does the opening 36 through which the slot is formed, the integrity of the casing, i.e., the structural strength of the casing, is maintained.

Figure 3:
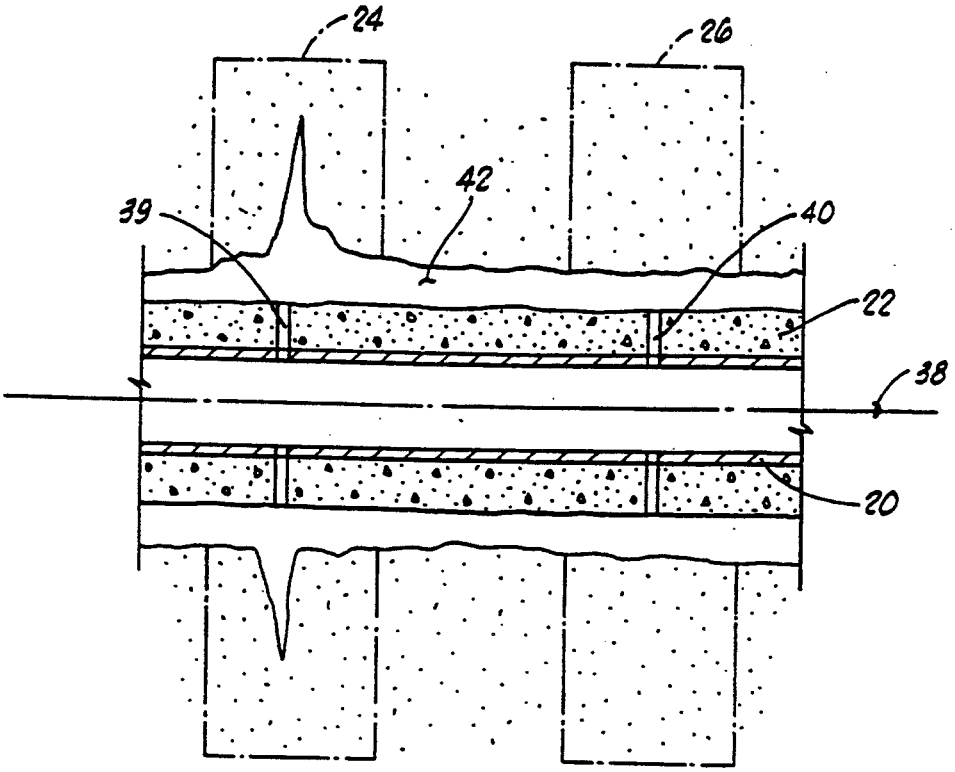
FIG. 3 (PRIOR ART)
FIG. 3 is a schematic illustration of the problem present in the prior art when multiple zones of a horizontal well are fractured, with the fracture propagating parallel to the wellbore so that the zones communicate with each other.

FIG. 3 illustrates a problem which occurs with prior art fracturing techniques for horizontal wells. It will be appreciated that FIG. 3 is a very schematic illustration. FIG. 3 generally shows the well casing 20 cemented in place within the wellbore 12 by cement 22.

Two subsurface zones to be fractured, such as zones 24 and 26 are illustrated. The location of openings such as perforations, casing valves or the like at locations adjacent zones 24 and 26 are schematically illustrated by the openings 39 and 40, respectively. The openings 39 and 40 are only schematically representative of some type of communication between the casing bore and the zones 24 and 26, respectively, which is present prior to the fracturing of the well.

One problem which often occurs when fracturing horizontal wells is that, when the fracture is initiated, the fracture will propagate generally parallel to the longitudinal axis 38 of the casing 20. This occurs due to the local stresses immediately surrounding the casing 20 and cement 22, and often it occurs around the cement-/formation bond, and thus will create a fracture space generally designated at 42 which generally follows the wellbore and may in fact provide communication between the two subsurface zones 24 and 26. Thus even if individual fracturing jobs are performed on the two zones 24 and 26, if a path of communication is formed between those zones, it may be that one or both of the zones will not be satisfactorily fractured, and of course individual production from the zones will not be possible. When the second zone is being fractured, as soon as the fracture space 42 communicates with another previously opened or fractured area, typically fracture growth will cease because the surface pump supplying the fracturing fluid will typically not have sufficient fluid flow to maintain fracturing pressures once the fracture is opened to a large, previously opened zone.

Figure 4:
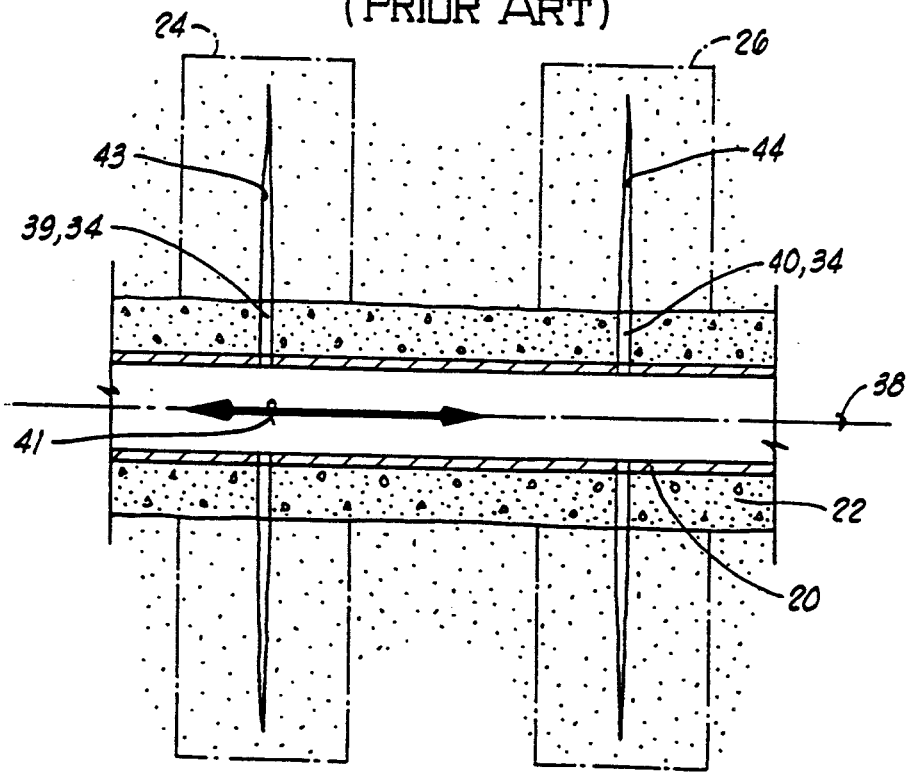
FIG. 4 is a schematic illustration of the manner in which fractures will propagate from the well utilizing the fan-shaped slots of the present invention when the least principal stress of the surrounding formation lies generally parallel to the longitudinal axis of the wellbore.
Figure 5:
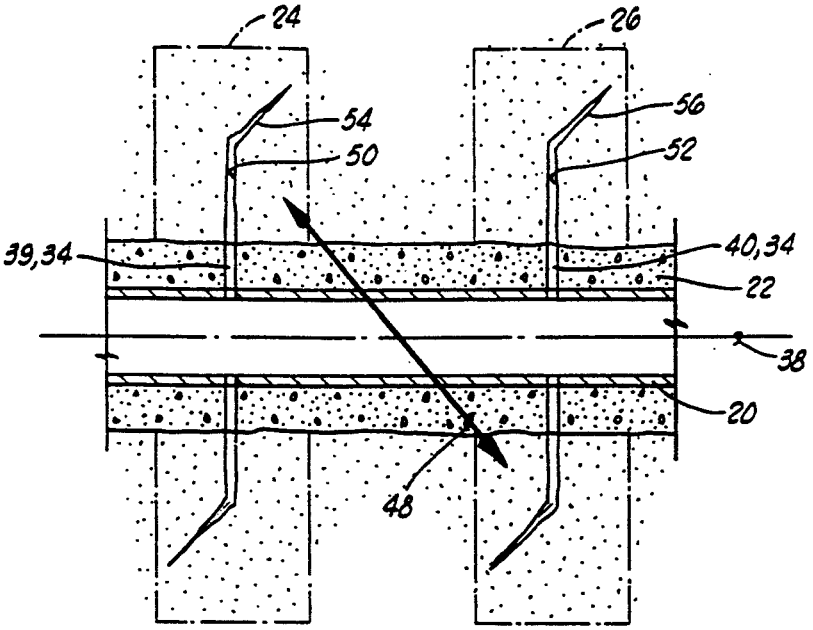
FIG. 5 is a view similar to FIG. 4 showing the manner in which fractures will propagate from the well utilizing the fan-shaped slots of the present invention when the least principal stress of the surrounding formation lies at an angle substantially transverse to the longitudinal axis of the wellbore. The fractures initially propagate outward in a plane perpendicular to the wellbore and then turn in a direction perpendicular to the least principal stress in the surrounding formation.

This problem is avoided by the use of the fan-shaped slots previously described as is schematically illustrated in FIGS. 4 and 5.

FIG. 4 schematically illustrates the situation which will occur when utilizing the methods of the present invention, when the least principal stress axis 41 naturally present in the surrounding formations lies generally parallel to the longitudinal axis 38 of the casing 20. If the openings generally represented at 39 and 40 are formed utilizing the fan-shaped slots illustrated in FIGS. 1 and 2, then the resulting fractures 43 and 44, respectively, will initiate in the plane of the fan-shaped slots 34 and will continue to radiate radially outward in generally that same plane as illustrated in FIG. 4. There will be no intercommunication between the zones 24 and 26 and each zone will be fractured in the desired manner.

FIG. 5 similarly illustrates what will happen when the least principal stress axis 48 is transverse to the longitudinal axis 38.

Again, the fractures will initiate and initially propagate outward in radial planes as indicated at 50 and 52, and will then turn in a direction generally perpendicular to the least principal stress axis 48 as indicated at 54 and 56, respectively.

Thus, in both of the cases shown in FIGS. 4 and 5, the fracture will initiate in the plane defined by the fan-shaped slots and will initially propagate a sufficient distance outward away from the casing 20 so that the local stresses around the casing 20 will not determine the ultimate direction of propagation of the fracture. The ultimate direction of propagation of the fracture will be determined by the least principal stress axis 41 or 48 present in the surrounding formation.

The fan-shaped slots 34 can be described as creating a localized least principal stress axis or direction in the formation substantially parallel to the longitudinal axis 38 thereby aiding subsequent fracture initiation in a plane generally perpendicular to the longitudinal axis 38.

The well 10 has been described herein as a substantially deviated well or horizontal well. It will be appreciated that the well need not be exactly horizontal to benefit from the present invention. Furthermore, even some substantially vertical wells may in some cases benefit from the use of the present invention. As used herein, the term highly deviated or substantially deviated well generally refers to a well the axis of which is deviated greater than 45° from a vertical direction.

The Use Of Expandable Casing Portions

Figure 6:
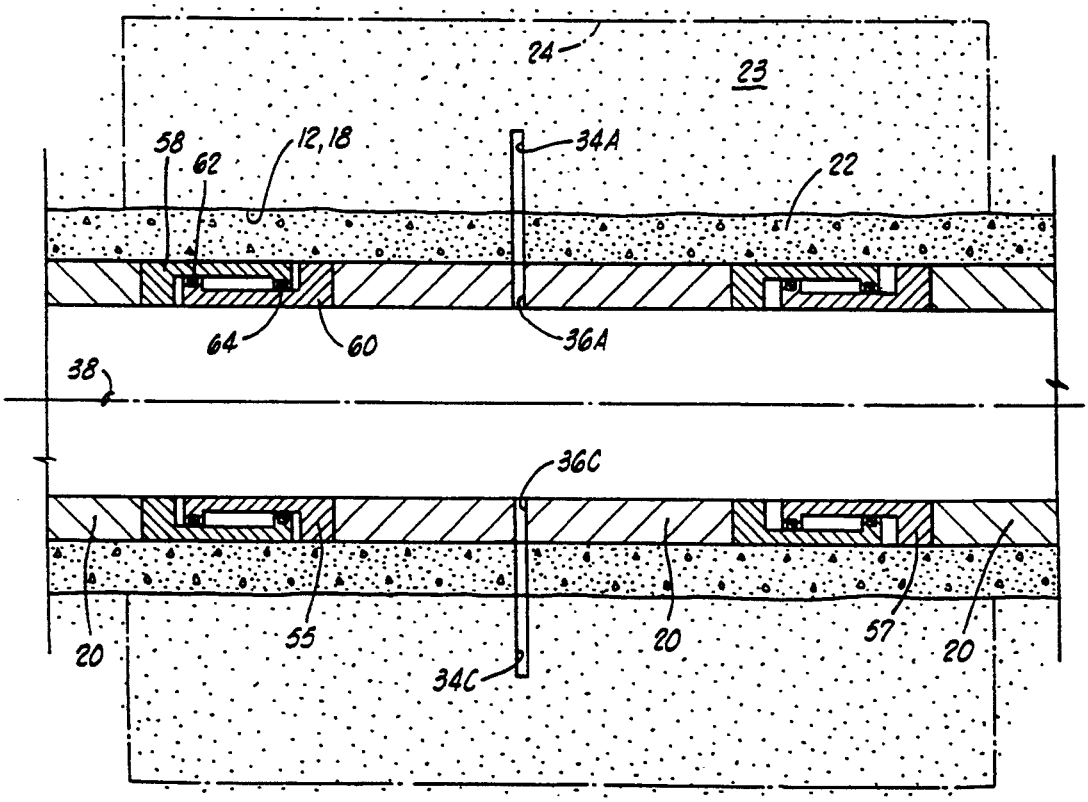
FIG. 6 is a schematic sectioned view of a portion of a horizontal well having a first embodiment of the expandable casing portions located in the casing on opposite sides of the location of the fan-shaped slots.
Figure 7:
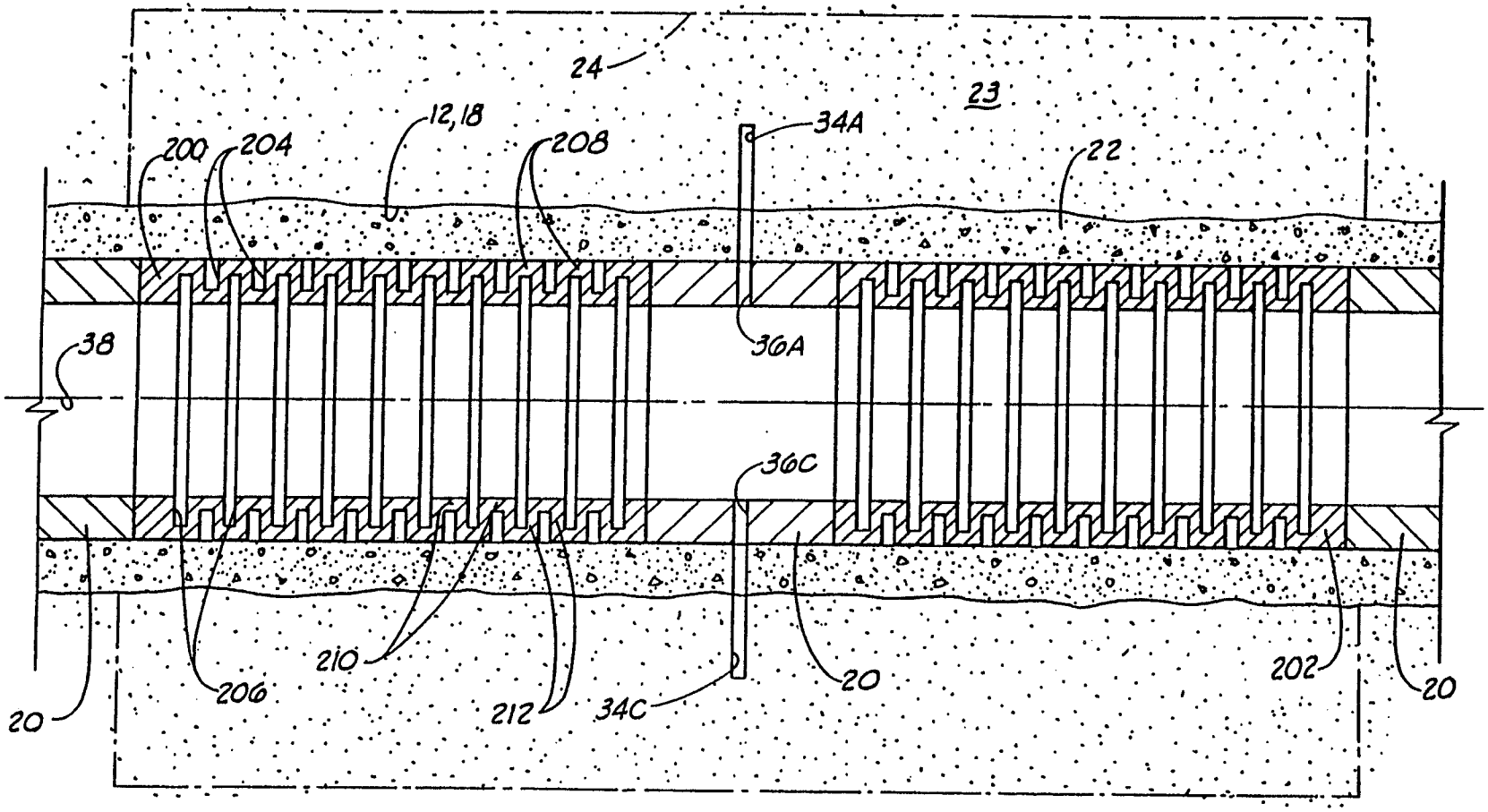
FIG. 7 is a schematic sectioned view of a portion of a horizontal well having a second embodiment of the expandable casing portions positioned in the casing on opposite sides of the location of the fan-shaped slots.
Figure 9:
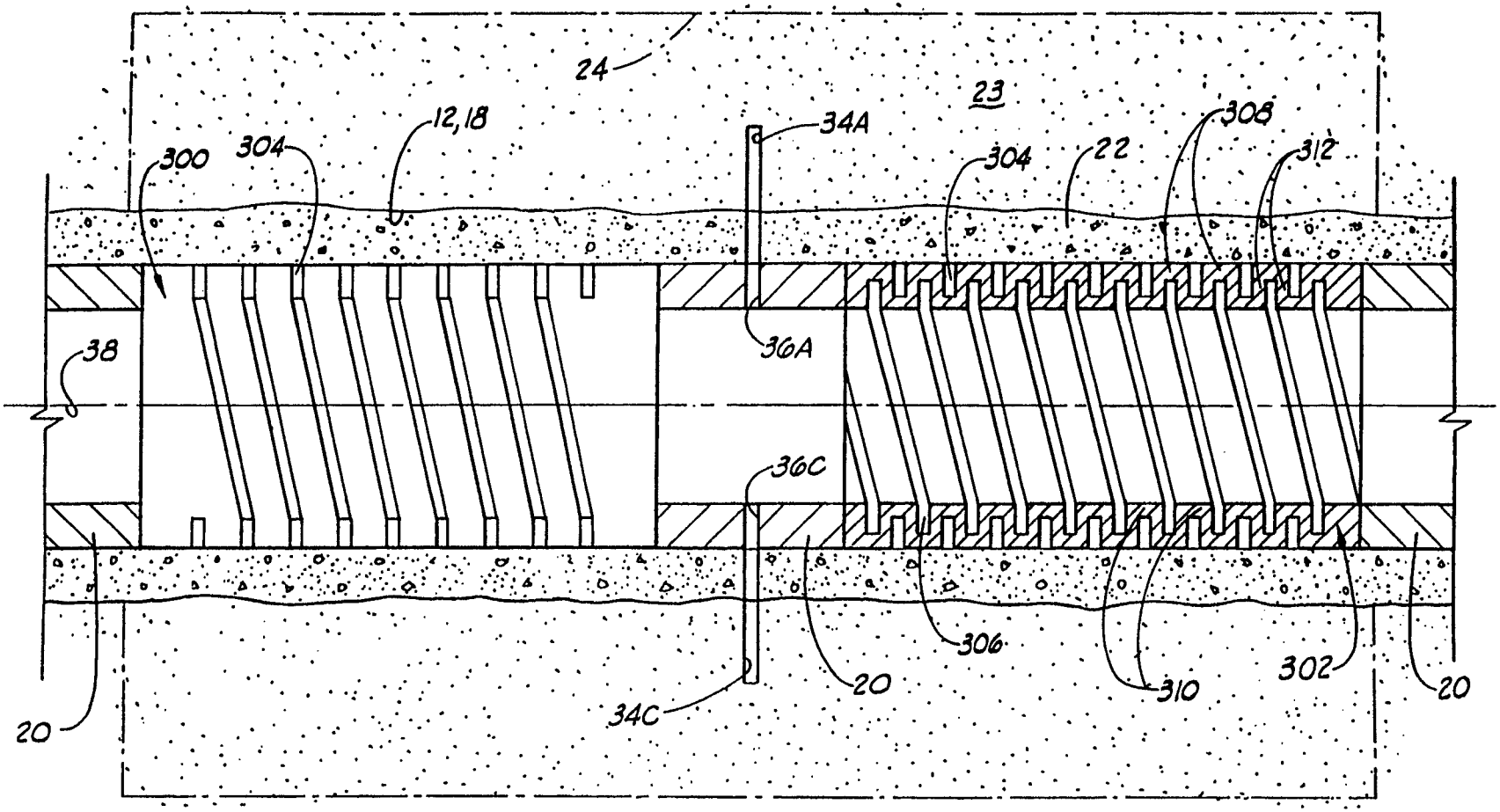
FIG. 9 is a schematic sectioned view of a portion of a horizontal well having a third embodiment of the expandable casing portions positioned in the casing on opposite sides of the location of the fan-shaped slots.

FIGS. 6, 7 and 9 illustrate another aspect of the present invention, which improves the success of fracturing operations on horizontal wells by the use of expandable casing joints. In the embodiment illustrated in FIG. 6, the expandable casing portions are characterized by casing slip joints, and in FIGS. 7 and 9, the expandable casing portions are characterized by expansion joints which function in a bellows-type manner.

The preferred orientation of fractures radiating outward from a horizontal well are generally like those described above with regard to FIGS. 4 and 5. One additional problem that occurs, however, particularly in connection with horizontal wells, is that when the fracture radiates outward in a plane perpendicular to the axis 38 of the well, this causes the surrounding rock formation to move in a direction parallel to the axis 38 of the well. Referring for example to the fracture 43 seen in FIG. 4, that portion of the formation to the right of the fracture 43 would move to the right, and that portion of the formation to the left of fracture 43 would move to the left relatively speaking. The casing 20, however, cannot move in either direction, and it cannot stretch sufficiently to accommodate the movement of the surrounding formation. Thus, the movement of the surrounding formation relative to the casing may cause the bond between the cement 22 and the casing 20 to break down. This is particularly a problem when the fracturing of multiple subsurface zones is involved, since this breakdown of the cement-to-casing bond will allow a path of communication between multiple zones which were intended to be isolated from each other by the cement.

The formation and cement will attempt to move relative to the casing 20. Since the cement generally has low shear strength of about 300 psi and a modulus of elasticity of about 1,000,000 psi, it can be predicted that the bond between the cement and casing will fail. The length of such a failure can be predicted by the following formula:

$$L = FW \times E/S$$

Where FW is the maximum fracture width during pumping, E is the modulus of elasticity, and S is the shear strength of the cement bond. In a typical situation, the destruction length, that is, the length over which the casing/cement bond is destroyed, can exceed 800 feet. This can become a major cause of zone communication and will make fracturing treatments of closely spaced zones less effective. Therefore, it is important to provide a means whereby this breakdown of the cement-/casing bond will not occur.

In FIG. 6, first and second casing slip joints 55 and 57 are provided on opposite sides of the fan-shaped slots 34. Then, when fracturing fluid is pumped into the fan-shaped slots 34 to create and propagate a fracture like fracture 43 seen in FIG. 4, the slip joints 55 and 57 will allow movement of the casing 20 on opposite sides of the fracture along with the surrounding formation, thus preventing the destruction of the bond between the casing 20 and cement 22 surrounding the casing during the fracturing operation.

The casing slip joints 55 and 57 are schematically illustrated in FIG. 6. Each includes two telescoping portions such as 58 and 60, preferably including sliding seals such as 62 and 64.

When the casing 20 is placed in the wellbore 12 and prior to placement of the cement 22 around the casing 20, steps should be taken to insure that the slip joints 55 and 57 are in a substantially collapsed position as shown in FIG. 6 so that there will be sufficient travel in the joints to allow the necessary movement of the casing. This can be accomplished by setting down weight on the casing 20 after it has been placed in the wellbore and before the cement 22 is placed or at least before the cement 22 has opportunity to set up.

Although two slip joints 55 and 57 are shown in FIG. 6 on opposite longitudinal sides of the openings 36, it will be appreciated that in many instances, a single slip joint will suffice to allow the necessary movement of the casing. It is preferred, however, to provide casing slip joints on both sides of the openings 36 to insure that any debonding of the cement 22 and casing 20 which may initiate adjacent the openings 36 will terminate when it reaches either of the slip joints 55 and 57 and will not propagate beyond the slip joints. This prevents any destruction of the cement/casing bond on a side of the slip joints longitudinally opposite the openings 36.

In FIG. 7, a second embodiment of the expandable casing portions is shown and characterized by first and second casing expansion joints 200 and 202 which are provided on opposite sides of the fan-shaped slots 34. When fracturing fluid is pumped into the fan-shaped slots 34 to create and propagate a fracture like fracture 43 seen in FIG. 4, the expansion joints 200 and 202 will allow movement of the casing 20 on opposite sides of the fracture along with the surrounding formation, thus preventing the destruction of the bond between casing 20 and cement 22 surrounding the casing during the fracturing operation.

Casing expansion joints 200 and 202 are schematically illustrated in FIG. 7. Each is generally tubular in configuration and has a plurality of annular, outer grooves 204 defined therein and a corresponding plurality of annular, inner grooves 206 defined therein. Inner grooves 206 are staggered with respect to outer grooves 204 such that the outer and inner grooves are alternately positioned as shown in FIG. 7.

Thus, each of casing expansion joints 200 and 202 may be said to comprise a plurality of outer wall segments 208 between corresponding pairs of outer grooves 204, and similarly, a plurality of inner wall segments 210 between corresponding pairs of inner grooves 206. It will be seen that an inner groove 206 is located radially inwardly from each outer wall segment 208, and an outer groove 204 is located radially outwardly from each inner wall segment 210.

Preferably, the outside diameter of inner grooves 206 is somewhat larger than the inside diameter of outer grooves 204 such that an annular, intermediate wall segment 212 is formed between adjacent inner and outer grooves. It will be seen that intermediate wall segments 212 thus interconnect outer wall segments 208 and inner wall segments 210.

Second embodiment casing expansion joints 200 and 202 are positioned in the casing 20 as shown in FIG. 7, and the cement 22 is placed around the casing in the normal manner. It is not necessary in this second embodiment to set down weight on the casing 20 after it has been placed in the wellbore and before the cement is placed, as is necessary to collapse the casing slip joints 55 and 57 of the first embodiment shown in FIG. 6.

The configuration of casing expansion joints 200 and 202 is such that each casing expansion joint provides a controlled weakened section of the casing string. During fracturing, casing expansion joints 200 and 202 allow movement of the casing 20 on opposite sides of the fracture by the expansion of the casing expansion joints. Referring to FIG. 8, this expansion is illustrated. Intermediate wall segments 212 provide the controlled weak point in casing expansion joints 200 and 202, and expansion thereof results in deflection of the intermediate wall segments in a bellows-like manner. That is, inner grooves 206 and outer grooves 204 are widened such that intermediate wall segments 212 will generally extend annularly between outer wall segments 208 and inner wall segments 210. Thus, there is movement allowed in the casing 20 as the fracture is propagated which prevents the destruction of the bond between the casing 20 and cement 22 surrounding the casing. Also, in the second embodiment of FIGS. 7 and 8, no sealing means is required as in the first embodiment slip joint configuration of FIG. 6.

In FIG. 9, a third embodiment of the expandable casing portions is shown and characterized by first and second casing expansion joints 300 and 302 which are provided on opposite sides of the fan-shaped slots 34. As with the second embodiment previously described, when fracturing fluid is pumped into the fan-shaped slots 34 to create and propagate a fracture like fracture 43 seen in FIG. 4, the expansion joints 300 and 302 will allow movement of the casing 20 on opposite sides of the fracture along with the surrounding formation, thus preventing the destruction of the bond between casing 20 and cement 22 surrounding the casing during the fracturing operation.

Casing joints 300 and 302 are schematically illustrated in FIG. 9. First casing expansion joint 300 is shown in elevation, and second casing expansion joint 302 is shown in cross section. However, first and second casing expansion joints 300 and 302 are substantially identical. Each is generally tubular in configuration and has at least one outer spiral groove 304 defined therein and at least one inner spiral groove 306 defined therein. Outer and inner spiral grooves 304 and 306 are formed similar to a screw thread. As best seen in the right-hand side of FIG. 9, inner spiral groove 306 is staggered or offset with respect to the corresponding outer spiral groove 304 such that the sectioned portions thereof appear to alternate.

Thus, each of casing expansion joints 300 and 302 may be said to comprise an outer spiral wall segment 308 and an inner spiral wall segment 310. If more than one outer spiral grooves 304 are formed, then there is a corresponding number of outer spiral wall segments 308. Similarly, if there are more than one inner spiral grooves 306, there are a corresponding number of inner spiral wall segments 310.

Preferably, the outside diameter of inner spiral groove 306 is somewhat larger than the inside diameter of outer spiral groove 304 such that an intermediate spiral wall segment 312 is formed between adjacent portions of outer spiral groove 304 and inner spiral groove 306. It will be seen that intermediate wall segments 312 thus interconnect outer spiral wall segment 308 and inner spiral wall segment 310.

Third embodiment casing expansion joints 300 and 302 are positioned in the casing 20 as shown in FIG. 9, and the cement 22 is placed around the casing in the normal manner as previously described for the other embodiments. It is not necessary in this third embodiment to set down weight on the casing 20 after it has been placed in the wellbore and before the cement is placed, as is necessary to collapse the casing slip joints 55 and 57 of the first embodiment shown in FIG. 6.

The configuration of casing expansion joints 300 and 302 is such that each casing expansion joint provides a controlled weakened section of the casing string. During fracturing, casing expansion joints 300 and 302 allow movement of the casing 20 on opposite sides of the fracture by the expansion of the casing expansion joints. Referring to FIG. 10, this expansion is illustrated. Intermediate spiral wall segments 312 provide the controlled weak point in casing expansion joints 300 and 302, and expansion thereof results in deflection of the intermediate spiral wall segments in a spiral bellows-like manner. That is, outer spiral groove 304 and inner spiral groove 306 are widened such that intermediate spiral wall segments 312 will generally extend angularly in cross section between outer spiral wall segment 308 and inner spiral wall segment 310. Thus, there is movement allowed in the casing 20 as the fracture is propagated which prevents the destruction of the bond between the casing 20 and cement 22 surrounding the casing. Also, in the third embodiment of FIGS. 9 and 10, no sealing means is required as in the first embodiment slip joint configuration of FIG. 6.

In the preferred third embodiment, outer spiral groove 304 and inner spiral groove 306 are cut in continuous spirals, such as in a screw thread, and around the outside and inside of the tubing, respectively. Since most casing joints 20 have right-hand threads, the spiral direction of outer and inner spiral grooves 304 and 306 are preferably cut in the manner of a left-hand thread to assure that the casing joint threaded connections do not become loose as casing expansion joints 300 and 302 are expanded. That is, as casing expansion joints 300 and 302 are expanded longitudinally, the thread-like spiral grooves 304 and 306 will tend to result in a screw-like relative rotation between opposite ends of the casing expansion joints. That is, as the casing expansion joints expand, there is some torque applied to casing 20. If outer spiral grooves 304 and 306 are cut in the same direction (right-hand) as the casing threads, this could result in loosening of the casing threaded connections.

This potential "unthreading" or "unwinding" problem with third embodiment casing expansion joints 300 and 302 may result in performance that is not quite as good as second embodiment casing expansion joints 300 and 302. However, in the third embodiment, the spiral grooves take considerably less time to machine and therefore are less expensive to produce than the plurality of annular grooves must be cut on both the inside and outside in the second embodiment.

The formation of the fan-shaped slots 34 can be generally described as forming a cavity 34 in the formation 23 and thereby creating in the subsurface formation 23 adjacent the cavity 34 a localized least principal stress direction substantially parallel to the longitudinal axis 38 of the casing 20. Thus, the fracture such as 43 (see FIG. 4) will initiate in a plane generally perpendicular to the longitudinal axis 38.

It will be appreciated that the aspect of the present invention utilizing the expandable casing portions may be used without the use of the fan-shaped slots described in FIGS. 1 and 2. The use of the fan-shaped slots is the preferred manner of initiating fractures in combination with the expandable casing portions. Other means may be used, however, for initiating the fracture in the preferred direction, that is, in a plane radiating outward generally perpendicular to the longitudinal axis 38.

Figure 2A:
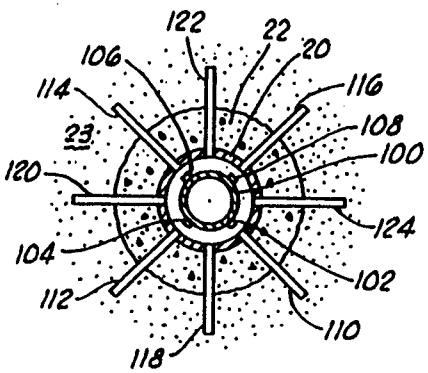
FIG. 2A is a view similar to FIG. 2, showing a pattern of eight radially extending bores located in a common plane perpendicular to the axis of the wellbore.

For example, FIG. 2A is a view similar to FIG. 2 which illustrates an alternative method of initiating the fracture in the preferred direction.

In FIG. 2A, a hydraulic jetting tool 100 has four jets 102, 104, 106 and 108 which are located in a common plane and spaced at 90° about the longitudinal axis of the tool 100. The jetting tool 100 may be located within the casing 20 and used to jet a first set of four radial bores or cavities 110, 112, 114 and 116. If more cavities are desired, the jetting tool 100 can then be rotated 45° to jet a second set of four radial bores 118, 120, 122 and 124.

Then when hydraulic fracturing fluid is applied under pressure to the radial bores 110–124, a fracture will tend to initiate generally in the plane containing the radial bores 110–124.

Apparatus For Forming Fan-Shaped Slots

In FIG. 2, one form of apparatus 28 for forming the fan-shaped slots 34 is schematically illustrated. The apparatus 28 includes a housing 126 having a jet nozzle 128 on one side thereof. A positioning wheel 130 is carried by a telescoping member 132 which extends when the telescoping member 132 is filled with hydraulic fluid under pressure.

When the apparatus 28 is first located within the casing 20 at the desired location for creation of a fan-shaped slot, hydraulic pressure is applied to the apparatus 28 thus causing the telescoping member 132 to extend the positioning wheel 130 thus pushing the jet nozzle 128 up against the inside of the casing 20. Hydraulic fluid exiting the jet nozzle 128 will soon form the opening such as 36A in the casing 20. The tip of the jet nozzle 128 will enter the opening 36A. Then, the apparatus 28 may be pivoted back and forth through a slow sweeping motion of approximately 40° total movement. Using the opening 36A as the pivot point for the tip of the jet nozzle 128, this back-and-forth sweeping motion will form the fan-shaped slot 34A.

Figure 11:
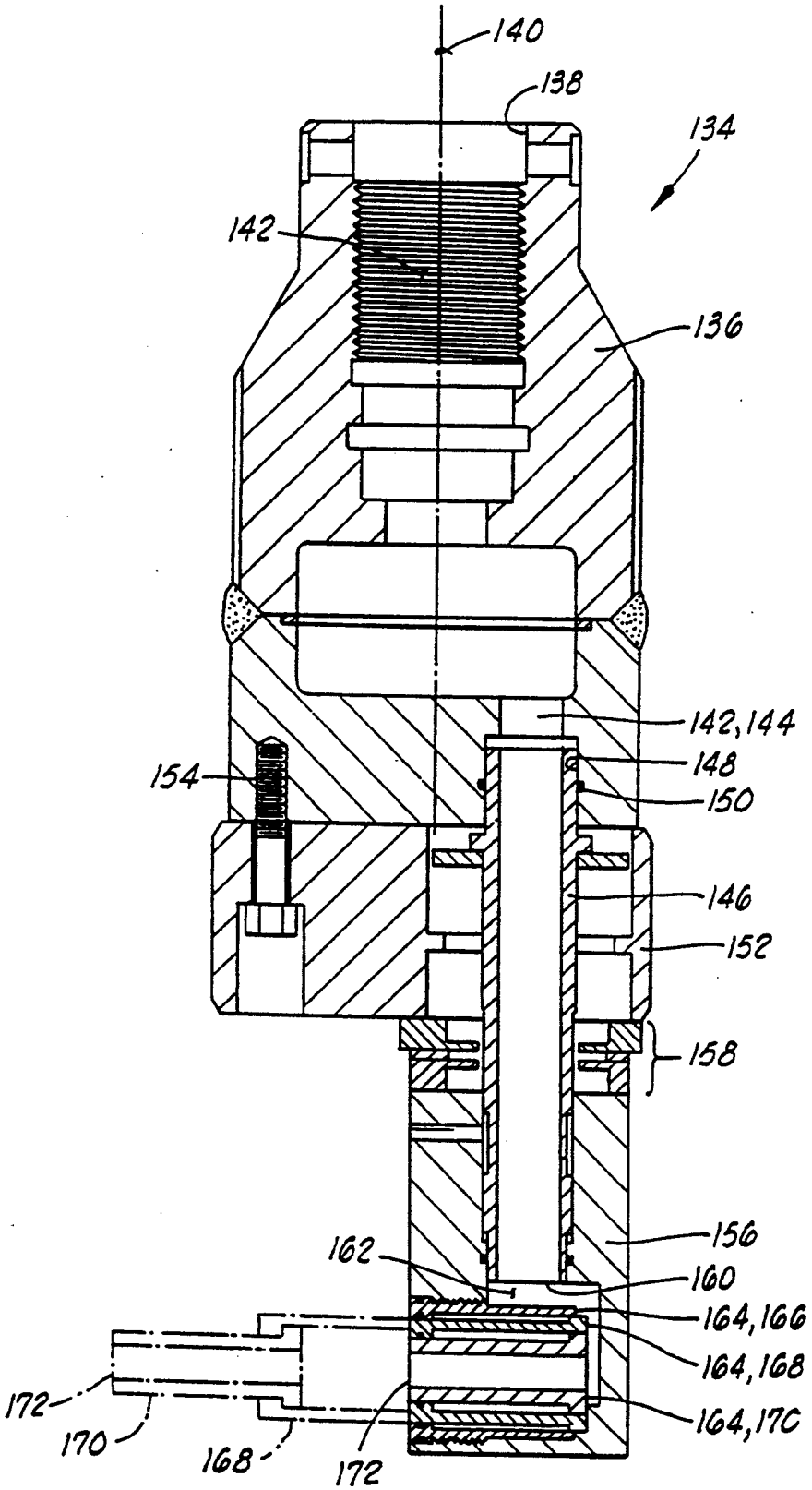
FIG. 11 is a sectioned elevation view of an alternative apparatus for cutting the fan-shaped slots.

FIG. 11 illustrates an alternative embodiment of a hydraulic jetting tool for cutting the fan-shaped slots. The hydraulic jetting tool of FIG. 11 is generally designated by the numeral 134. The apparatus 134 includes a housing 136 having an upper end with an upper end opening 138 adapted to be connected to a conventional tubing string such as 30 (see FIG. 1) on which the apparatus 134 is lowered into the well. The tubing string 30 will preferably carry a centralizer (not shown) located a short distance above the upper end of the apparatus 134 so that the apparatus 134 will have its longitudinal axis 140 located generally centrally within the casing 20.

The housing 136 has an irregular passage 142 defined therethrough. The irregular passage 142 includes an eccentrically offset lower portion 144. A hollow shaft 146 has its upper end portion received within a bore 148 of eccentric passage portion 144 with an 0-ring seal 150 being provided therebetween. An end cap 152 is attached to housing 136 by bolts such as 154 to hold the hollow shaft 146 in place relative to housing 136.

A nozzle holder 156 is concentrically received about the lower end portion of hollow shaft 146 and is rotatably mounted relative to end cap 152 by a swivel schematically illustrated and generally designated by the numeral 158. The hollow shaft 146 has an open lower end 160 communicated with a cavity 162 defined in the nozzle holder 156.

A laterally extendable telescoping nozzle 164 is also received in cavity 162. Telescoping nozzle 164 includes an outer portion 166, an intermediate portion 168, and an innermost portion 170.

When hydraulic fluid under pressure is provided to the cavity 162, the differential pressures acting on the innermost portion 170 and intermediate portion 168 of telescoping nozzle 164 will cause the innermost portion 170 to move to the left relative to intermediate portion 168, and will cause the intermediate portion 168 to extend to the left relative to outer portion 164, so that an open outer end 172 of the telescoping nozzle 164 will extend to the position shown in phantom lines in FIG. 11.

Thus, to use the apparatus 134 of FIG. 11, the apparatus is lowered into the well on the tubing string 30 until it is adjacent the location where it is desired to cut the fan-shaped slots. Then hydraulic fluid under pressure is provided through tubing string 30 to the apparatus 134 to cause the telescoping nozzle 164 to extend outward to the position shown in phantom lines in FIG. 11 wherein the open outer end 172 will be adjacent the inner wall of the casing 20. The hydraulic fluid exiting the open end 172 will soon create an opening 36 in the wall of casing 20 through which the outer end 172 of the inner nozzle portion 170 will extend. Then, the apparatus 134 is continuously rotated about its longitudinal axis 140 by rotating tubing string 30. The eccentric location of nozzle holder 156 will thus cause the nozzle 164 to pivot back and forth through an angle about the opening 36 which forms the pivot point for the outer end 172 of the telescoping nozzle 164. As the apparatus 134 rotates, the nozzle 164 will partially collapse and then extend so that open end 172 stays in opening 36.

After a first fan-shaped slot such as 34A has been formed, hydraulic pressure is released while the apparatus 134 is rotated through an angle of approximately 90°. Then hydraulic pressure is again applied and the telescoping nozzle 174 will again be pressed against the inner wall of casing 20 and the process is repeated to form another fan-shaped slot such as 34B.

The Embodiment of FIG. 12

FIG. 12 is a view similar to FIG. 1 showing the use of certain aspects of the present invention in connection with a well wherein the horizontal portion of the well includes portions of slotted casing separated by portions of solid casing incorporating slip joints and utilizing the radial slotting techniques of the present invention.

In FIG. 12, the horizontal portion of the well includes first, second and third segments of slotted casing designated as 172, 174 and 176, respectively. Those segments of slotted casing are surrounding by open portions of the borehole 12 so that the borehole 12 freely communicates with the interior of the slotted casing through slots such as generally designated as 178. The borehole surrounding the slotted casing segments may be gravel packed.

Located between the segments of slotted casing are first and second segments of solid casing 180 and 182. Each segment of solid casing includes expandable casing portions such as previously described with regard to FIGS. 6, 7 and 9.

The wellbore adjacent each of the segments 180 and 182 of solid casing is spot-cemented as indicated at 184 and 186, respectively. The segments of solid casing are then communicated with the zones 24 and 26, respectively, through the use of the radial slotting techniques previously described wherein slots 34 and openings 36 are formed through the solid casing at locations between the expandable casing portions.

Then, a straddle packer (not shown) can be lowered on tubing string into the casing so as to fracture the zones of interest 24 and 26 individually through their fan-shaped slots 34. The expandable casing portions, along with the fan-shaped slots 34, will cause the fractures to radiate outward into the zones 24 and 26 while the spot-cement 184 and 186 will still provide isolation between the zones 24 and 26.

Thus it is seen that the present invention readily achieves the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A method of fracturing a subsurface formation of a well having a well casing cemented in a borehole intersecting said subsurface formation, comprising:

(a) providing an opening through said casing communicating an interior of said casing with said subsurface formation;

(b) providing at least a first casing expansion joint in said casing, said casing expansion joint defining a spiral groove therein such that said expansion joint may expand in a bellows-like manner;

(c) communicating a fracturing fluid through said opening to said subsurface formation;

(d) applying pressure to said fracturing fluid and through said opening to said subsurface formation;

(e) initiating a fracture in said subsurface formation adjacent said opening;

(f) during step (e), allowing said casing to move with said subsurface formation by means of expansion of said first casing expansion joint; and (g) thereby preventing destruction of a bond between said casing and cement surrounding said casing during step (e).

2. The method of claim 1, wherein:

in step (a), said opening is provided in a highly deviated portion of said well.

3. The method of claim 2, wherein:

in step (a), said opening is provided in a substantially horizontal portion of said well.

4. The method of claim 1, wherein:

step (b) includes providing a second casing expansion joint in said casing, said first and second casing expansion joints being on opposite longitudinal sides of said opening.

5. The method of claim 4, wherein:

in step (b), said second casing expansion joint is provided as an expansion joint defining a spiral groove therein such that said second expansion joint may expand in a bellows-like manner.

6. The method of claim 1, wherein:

step (g) includes terminating any destruction of said bond at said expandable casing portion and thereby preventing any destruction of said bond on a side of said casing expansion joint longitudinally opposite said opening.

7. The method of claim 1 further comprising:

forming said opening in a cavity in said formation and thereby creating in said subsurface formation adjacent said cavity a localized least principal stress direction substantially parallel to the longitudinal axis of said casing; and in step (e), initiating said fracture at said cavity in a plane generally perpendicular to said longitudinal axis.

8. The method of claim 7, wherein:

said forming of said cavity includes forming a fan-shaped slot in said formation, said fan-shaped slot circumscribing a substantially larger arc about said axis than does the opening through which said slot was formed.

9. The method of claim 7, wherein:

said forming of said cavity includes forming a plurality of radially extending holes in said formation, said holes lying generally in said plane perpendicular to said longitudinal axis.

10. The method of claim 1, wherein:

in step (b), said spiral groove is an outer spiral groove on said first casing expansion joint.

11. The method of claim 1, wherein:

in step (b), said spiral groove is an inner spiral groove in said first casing expansion joint.

12. The method of claim 1, wherein:

in step (b), said first casing expansion joint is provided with said spiral groove being an outer spiral groove and further provided with an inner spiral groove, said outer spiral groove and inner spiral groove cooperating such that said expansion joint may expand in a bellows-like manner.

13. The method of claim 12, wherein:

said inner spiral groove has an outside diameter larger than an inside diameter of said outer spiral groove.

14. A method of fracturing a subsurface formation of a well having a well casing cemented in a borehole intersecting the subsurface formation, said method comprising:

(a) providing an opening through said casing communicating an interior of said casing with said subsurface formation;

(b) providing at least a first expansion joint in said casing, said first expansion joint having a bellows-type construction defining an outer spiral groove and an inner spiral groove therein;

(c) communicating a fracturing fluid under pressure through said opening to said subsurface formation;

(d) initiating a fracture in said subsurface formation adjacent said opening;

(e) during step (b), allowing expansion of said first expansion joint and thereby allowing movement of said casing with said subsurface formation; and (f) thereby preventing destruction of a bond between said casing and cement surrounding said casing during step (d).

15. The method of claim 14 wherein:

in step (a), said opening is provided in a highly deviated portion of said well.

16. The method of claim 14 wherein:

in step (a), said opening is provided in a substantially horizontal portion of said well.

17. The method of claim 14 wherein:

step (b) further includes providing a second expansion joint in said casing substantially similar to said first expansion joint, said first and second expansion joints being disposed on opposite longitudinal sides of said opening.

18. The method of claim 17 wherein:

said first and second expansion joints allow expansion in opposite directions.

19. The method of claim 14 wherein:

said outer and inner spiral grooves are formed in an opposite direction from threaded joints of said casing.

20. The method of claim 14 wherein:

said inner spiral groove has an outside diameter greater than an inside diameter of said outer spiral groove.

21. The method of claim 14, wherein:

step (f) includes terminating any destruction of said bond at said expansion joint and thereby preventing any destruction of said bond on the side of said expansion joint longitudinally opposite said opening.

22. The method of claim 14 further comprising:

forming said opening in a cavity in said formation and thereby creating said subsurface formation adjacent said cavity a localized least principal stress direction substantially parallel to the longitudinal axis of said casing; and in said step (d), initiating said fracture at said cavity in a plane generally perpendicular to said longitudinal axis.

23. The method of claim 22, wherein:

said forming of said cavity includes forming a fan-shaped slot in said formation, said fan-shaped slot circumscribing a substantially larger arc about said axis than does the opening through which said slot is formed.

24. The method of claim 22, wherein:

said forming of said cavity includes forming a plurality of radially extending holes in said formation, said holes lying generally in said plane perpendicular to said longitudinal axis.

* * * * *